US011993891B2

(12) United States Patent
Assis et al.

(10) Patent No.: US 11,993,891 B2
(45) Date of Patent: May 28, 2024

(54) LAUNDRY TREATING APPLIANCE WITH FOREIGN OBJECT BARRIER

(71) Applicant: WHIRLPOOL CORPORATION, Benton Harbor, MI (US)

(72) Inventors: Clovis Douglas Minchola De Assis, Rio Claro (BR); Thiago Francisco Buzzo, Rio Claro (BR); Leonardo Souza Campos, Rio Claro (BR); Wagner Jose Finassi Pinto, Campinas (BR)

(73) Assignee: Whirlpool Corporation, Benton Harbor, MI (US)

( * ) Notice: Subject to any disclaimer, the term of this patent is extended or adjusted under 35 U.S.C. 154(b) by 123 days.

(21) Appl. No.: 17/671,066

(22) Filed: Feb. 14, 2022

(65) Prior Publication Data

US 2023/0257924 A1 Aug. 17, 2023

(51) Int. Cl.
*D06F 39/10* (2006.01)
*D06F 39/08* (2006.01)

(52) U.S. Cl.
CPC ..... *D06F 39/10* (2013.01); *D06F 39/085* (2013.01)

(58) Field of Classification Search
CPC ..... D06F 39/10; D06F 39/085; D06F 58/22; D06F 2103/42; A47L 15/4202; D05F 43/085
USPC ..... 68/18 F, 208; 134/104.4, 110; 210/463, 210/454
See application file for complete search history.

(56) References Cited

U.S. PATENT DOCUMENTS 1,969,176 A * 8/1934 Kirby ..... D06F 13/02 74/79
2,413,954 A * 1/1947 Conterman ..... D06F 39/10 210/454
2,512,394 A * 6/1950 Sullivan ..... D06F 39/10 D23/209
2,687,216 A * 8/1954 Shelton ..... D06F 39/10 210/463
2,922,526 A * 1/1960 Ohmann ..... D06F 37/42 210/232
3,681,947 A * 8/1972 Cowan ..... B01D 29/46 210/167.01
4,066,094 A * 1/1978 Stitch ..... D06F 39/083 68/12.14
4,125,003 A * 11/1978 Wasemann ..... D06F 39/10 68/208
4,485,645 A * 12/1984 Mulder ..... D06F 39/10 68/18 F
4,505,138 A * 3/1985 Lang ..... D06F 39/10 210/463

(Continued)

FOREIGN PATENT DOCUMENTS

EP 2280113 A1 2/2011
EP 2325378 A1 5/2011

(Continued)

*Primary Examiner* — David G Cormier
*Assistant Examiner* — Thomas Bucci
(74) *Attorney, Agent, or Firm* — McGarry Bair PC

(57) ABSTRACT

Household appliances, such as for laundry treatment, can be configured with a sump and an outlet having a barrier for foreign objects. Foreign objects such as pocket items can inadvertently be added to the appliance along with the wash items. A barrier secured in the opening of the outlet can prevent pocket items from entering the drain.

20 Claims, 11 Drawing Sheets

(56) References Cited

U.S. PATENT DOCUMENTS

| | | | | |
|---|---|---|---|---|
| 7,966,848 | B2 | 6/2011 | Jang et al. | |
| 9,422,661 | B2 | 8/2016 | Mantle et al. | |
| 9,657,428 | B2 | 5/2017 | Jeong et al. | |
| 2004/0108260 | A1 | 6/2004 | Heo | |
| 2007/0018453 | A1* | 1/2007 | Iturralde | F16L 17/025 285/220 |
| 2016/0186371 | A1* | 6/2016 | Cinello | D06F 37/267 68/208 |

FOREIGN PATENT DOCUMENTS

| | | | |
|---|---|---|---|
| EP | 2503050 | B1 | 12/2013 |
| EP | 2998426 | B1 | 11/2017 |

* cited by examiner

LAUNDRY TREATING APPLIANCE WITH FOREIGN OBJECT BARRIER

BACKGROUND

Household appliances, such as for laundry treatment, can be configured with a sump and a pump outlet having a barrier for foreign objects. Such barriers prevent small items, such as keys, coins, clips, and the like, from entering the pump, such as the recirculation pump or the drain pump. The small items can inadvertently be introduced to the laundry appliance and can interfere with the operation of the appliance if they enter the pump. Therefore, a barrier can be secured in the opening of an inlet to the pump to prevent such objects from entering the pump.

BRIEF SUMMARY

In one aspect, the present disclosure relates to a laundry treating appliance comprising a tub having a wall having an outer surface and an inner surface, with the inner surface at least partially defining a liquid chamber, an outlet formed in the wall, a foreign object barrier having a filter extending through the outlet and into the liquid chamber, and a stop confronting the outer surface, and a pump case fluidly coupled to the outlet and having a catch located on an opposite side of the stop than the outer surface to trap the stop between the outer surface and the catch.

In another aspect, the present disclosure relates to a laundry treating appliance comprising a tub having a wall having an outer surface and an inner surface, with the inner surface at least partially defining a liquid chamber; an outlet formed in the wall, a filter having a resilient sieve, at least partially overlying the inner surface, and a collar, at least partially overlying the outer surface, and a pump assembly having a portion confronting the collar, thereby limiting the axial movement of the filter toward the portion of the pump assembly.

DETAILED DESCRIPTION

Figure 1:
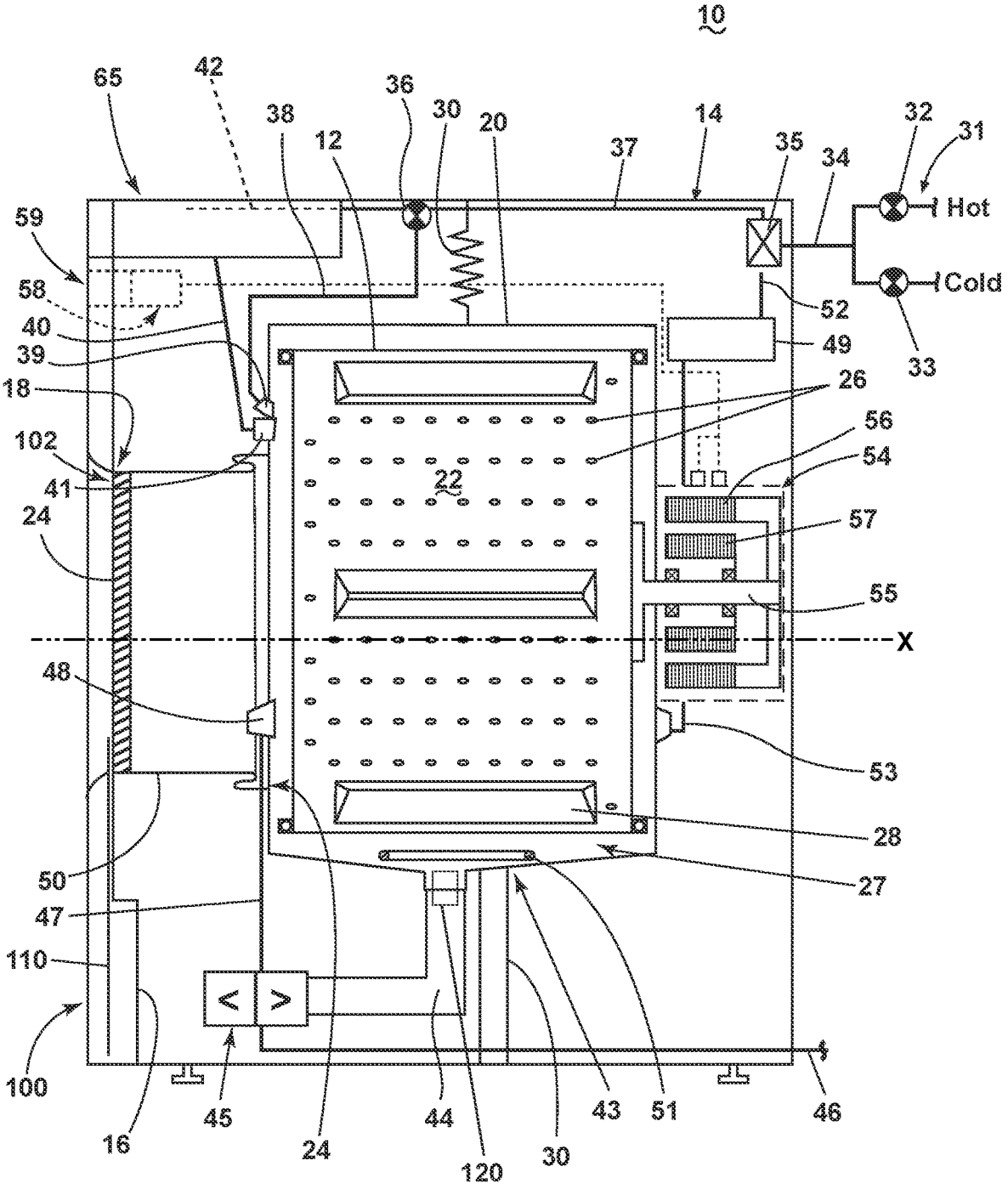
FIG. 1 is a schematic cross-sectional view of a laundry treating appliance including a door assembly in a closed condition.

Aspects of the disclosure relate to a pump assembly for a household appliance. Pump assemblies for household appliances can include a variety of features and components, including a filter, structures for preventing the passage of small items through the pump assembly, or structures for holding the filter in place, in non-limiting examples. Traditional pump assemblies can include a drain assembly having a sump and a pump, which are fluidly connected by some form of a conduit. The pump can be a drain pump, but it can also be any other type of pump, such as a recirculation pump.

The described aspects of the present disclosure have applicability in a variety of household appliances including, but not limited to, laundry treating appliances, refreshers, dishwashers, or the like. Some non-limiting examples of laundry treating appliances include laundry washing appliances, laundry drying appliances, combination laundry washer/dryers, refreshing/revitalizing machines, extractors, non-aqueous washing apparatuses, or the like. In some examples, laundry treating appliances can be front-loading or top-loading. In some examples, laundry treating appliances can be in a horizontal-axis or a vertical-axis arrangement. Aspects of the disclosure can have applicability to any appliance having a door, whether it be hingedly connected to a cabinet, slidable in or out of a cabinet, or combinations thereof.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of the disclosure. Connection references (e.g., attached, coupled, connected, or joined) are to be construed broadly and can include intermediate members between a collection of elements and relative movement between elements unless otherwise indicated. As such, connection references do not necessarily infer that two elements are directly connected and in fixed relation to one another. Furthermore, as used herein, the term "set" or a "set" of elements can be any number of elements, including only one. As used herein, the terms "first", "second", and "third" may be used interchangeably to distinguish one component from another and are not intended to signify location or importance of the individual components. The exemplary drawings are for purposes of illustration only and the dimensions, positions, order and relative sizes reflected in the drawings attached hereto can vary.

FIG. 1 is a schematic view of a laundry treating appliance 10 according to aspects of the present disclosure. The laundry treating appliance 10 can be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus;

and a revitalizing machine. While the laundry treating appliance 10 of FIG. 1 is illustrated as a horizontal axis, front-load laundry treating appliance 10, the aspects of the present disclosure can have applicability in laundry treating appliances with other configurations. Depending on the configuration, it is possible for the aspects of the present disclosure to have applicability in other appliances having a door, whether it be hinged, slidable, or otherwise attached to a cabinet, with access to a treating chamber.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 of FIG. 1 is illustrated as a horizontal-axis laundry treating appliance 10, which can include a structural support system including a cabinet 14, which defines a housing within which a laundry holding system resides. The cabinet 14 can be a housing having a chassis and/or a frame, to which decorative panels can or cannot be mounted, defining an interior enclosing component typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure. The cabinet 14 can include a front panel 16 that defines a front panel opening 18 to allow user access to the interior of the cabinet 14.

The laundry holding system of the illustrated laundry treating appliance 10 can include a tub 20 supported within the cabinet 14 by a suitable suspension system, the tub 20 at least partially defining a treating chamber 22 for laundry items. A drum 12 can be provided within the tub 20 to further define at least a portion of the treating chamber 22. The treating chamber 22 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket. The front panel opening 18 can provide access to the treating chamber 22. The drum 12 can be either imperforate or perforated, including a plurality of perforations 26 such that liquid can flow between the tub 20 and the drum 12 through the perforations 26. A plurality of baffles 28 can be disposed on an inner surface of the drum 12 to lift the laundry load received in the treating chamber 22 while the drum 12 rotates. It will be understood that it is also within the scope of the present disclosure for the laundry holding system to comprise only the tub 20, without a drum, to define the treating chamber 22. The laundry treating appliance 10 can further include a suspension system 30 for dynamically suspending the laundry holding system within the structural support system.

The tub 20 can also define a wall 21, which has an inner surface 23 and an outer surface 25. The inner surface 23 at least partially defines a liquid chamber 27. The tub 20 can also define a tub opening 24, which can be thought of as a treating chamber opening and which can be at least partially aligned with the front panel opening 18 of the cabinet 14. In one example, the tub 20, along with the tub opening 24, the drum 12, and the front panel opening 18 can have central axes that are co-axial with one another, or with at least one of the other axes, such that a common central axis X is formed. Optionally, and especially in the case that the laundry treating appliance 10 is provided as a washing machine, rather than a clothes dryer, a bellows 50 can extend between the tub opening 24 and the front panel opening 18 to couple the front panel opening 18 of the cabinet 14 with the tub opening 24 of the tub 20. The bellows 50 can sealingly couple the tub opening 24 and the front panel opening 18 such that liquid is not permitted to move from the tub 20 into the interior of the cabinet 14.

A door assembly 100 can be included with the laundry treating appliance 10. The door assembly 100 can be movably mounted or coupled to the cabinet 14. By way of non-limiting example, the door assembly 100 can be hingedly coupled to the cabinet 14 for movement between an opened condition (FIG. 2) and a closed condition as shown. In the closed condition, the door assembly 100 can seal against the front panel opening 18 or the bellows 50 and can be coextensive with and prevent access to the front panel 16. In the opened condition, the door assembly 100 can be spaced apart from the front panel opening 18 and the bellows 50 and can allow access to the front panel 16. The door assembly 100 can include an access opening 102 through which the treating chamber 22 can be selectively accessed. A window panel 110 can be movably coupled with the door assembly 100 for movement between a lowered, or opened, position and a raised, or closed, position and coextensive with the access opening 102 to selectively allow access to the treating chamber 22 through the access opening 102, without the need to open/close the door assembly 100. In one example, the window panel 110 can be entirely slidably received within the door assembly 100 for movement between the lowered position and the raised position. The door assembly 100 can further comprise a front fascia. By way of non-limiting example, when the laundry treating appliance 10 is a washing machine and the bellows 50 is included, the door assembly 100, and specifically the window panel 110, can align with and seal against the bellows 50. When the laundry treating appliance 10 is a clothes dryer, in which the bellows 50 may not be included, the door assembly 100, and specifically the window panel 110, can align with and seal against the front panel opening 18, with an optional seal, such as a gasket seal, provided between the door assembly 100 and the front panel opening 18.

Optionally, and, for example, in the case that the laundry treating appliance 10 is provided as a washing machine, the laundry treating appliance 10 can further include a liquid supply system for supplying water to the laundry treating appliance 10 for use in treating laundry during a cycle of operation. The liquid supply system can include a source of water, such as a household water supply 31, which can include separate valves 32 and 33 for controlling the flow of hot and cold water, respectively. Water can be supplied through an inlet conduit 34 directly to the tub 20 by controlling first and second diverter mechanisms 35 and 36, respectively. The diverter mechanisms 35, 36 can be a diverter valve having two outlets such that the diverter mechanisms 35, 36 can selectively direct a flow of liquid to one or both of two flow paths. Water from the household water supply 31 can flow through the inlet conduit 34 to the first diverter mechanism 35 which can direct the flow of liquid to a supply conduit 37. The second diverter mechanism 36 on the supply conduit 37 can direct the flow of liquid to a tub outlet conduit 38 which can be provided with a spray nozzle 39 configured to spray the flow of liquid into the tub 20. In this manner, water from the household water supply 31 can be supplied directly to the tub 20. While the valves 32, 33 and the conduit 34 are illustrated exteriorly of the cabinet 14, it will be understood that these components can be internal to the cabinet 14.

The laundry treating appliance 10 can also optionally be provided with a dispensing system for dispensing treating chemistry to the treating chamber 22 for use in treating the laundry according to a cycle of operation. The dispensing system can include a treating chemistry dispenser 65 which can be a single dose dispenser, a bulk dispenser, or an integrated single dose and bulk dispenser and is fluidly coupled to the treating chamber 22. The treating chemistry dispenser 65 can be configured to dispense a treating chemistry directly to the tub 20 or mixed with water from the liquid supply system through a dispensing outlet conduit 40. The dispensing outlet conduit 40 can include a dispensing nozzle 41 configured to dispense the treating chemistry into the tub 20 in a desired pattern and under a desired amount of pressure. For example, the dispensing nozzle 41 can be configured to dispense a flow or stream of treating chemistry into the tub 20 by gravity, i.e. a non-pressurized stream. Water can be supplied to the treating chemistry dispenser 65 from the supply conduit 37 by directing the diverter mechanism 36 to direct the flow of water to a dispensing supply conduit 42.

The treating chemistry dispenser 65 can include multiple chambers or reservoirs fluidly coupled to the treating chamber 22 for receiving doses of different treating chemistries. The treating chemistry dispenser 65 can be implemented as a dispensing drawer that is slidably received within the cabinet 14, or within a separate dispenser housing which can be provided in the cabinet 14. The treating chemistry dispenser 65 can be moveable between a fill position, where the treating chemistry dispenser 65 is exterior to the cabinet 14 and can be filled with treating chemistry, and a dispense position, where the treating chemistry dispenser 65 is interior of the cabinet 14.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The laundry treating appliance 10 can also optionally include a recirculation and drain system for optionally recirculating liquid within the laundry holding system and for draining liquid from the laundry treating appliance 10. Liquid supplied to the tub 20 through tub outlet conduit 38 and/or the conduit 40 typically enters a space between the tub 20 and the drum 12 and can flow by gravity to a sump 43 formed in part by a lower portion of the tub 20. The sump 43 can alternatively be a separate piece mounted to the wall 21. The sump 43 can also be formed by a sump conduit 44 that can fluidly couple the lower portion of the tub 20 to a pump 45. A foreign object barrier 120 can be positioned between the sump 43 and the sump conduit 44 to trap small objects such as coins and hairclips. The pump 45 can direct liquid to a drain conduit 46, which can drain the liquid from the laundry treating appliance 10, or to a recirculation conduit 47, which can terminate at a recirculation inlet 48. The recirculation inlet 48 can direct the liquid from the recirculation conduit 47 into the drum 12. The recirculation inlet 48 can introduce the liquid into the drum 12 in any suitable manner, such as by spraying, dripping, or providing a steady flow of liquid. In this manner, liquid provided to the tub 20, with or without treating chemistry, can be recirculated into the treating chamber 22 for treating the laundry within.

The liquid supply and/or recirculation and drain system can be provided with a heating system which can include one or more devices for heating laundry and/or liquid supplied to the tub 20, such as a steam generator 49 and/or a sump heater 51. Liquid from the household water supply 31 can be provided to the steam generator 49 through the inlet conduit 34 by controlling the first diverter mechanism 35 to direct the flow of liquid to a steam supply conduit 52. Steam generated by the steam generator 49 can be supplied to the tub 20 through a steam outlet conduit 53. The steam generator 49 can be any suitable type of steam generator 49 such as a flow through steam generator or a tank-type steam generator. Alternatively, the sump heater 51 can be used to generate steam in place of or in addition to the steam generator 49. In addition or alternatively to generating steam, the steam generator 49 and/or sump heater 51 can be used to heat the laundry and/or liquid within the tub 20 as part of a cycle of operation.

It is noted that the illustrated suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry. For example, the liquid supply system can include a single valve for controlling the flow of water from the household water source. In another example, the recirculation and pump system can include two separate pumps for recirculation and draining, instead of the single pump as previously described.

The laundry treating appliance 10 also includes a drive system for rotating the drum 12 within the tub 20. The drive system can include a motor 54 for rotationally driving the drum 12. The motor 54 can be directly coupled with the drum 12 through a drive shaft 55 to rotate the drum 12 about a rotational axis during a cycle of operation. The motor 54 can be a brushless permanent magnet (BPM) motor having a stator 56 and a rotor 57. Alternately, the motor 54 can be coupled with the drum 12 through a belt and a drive shaft to rotate the drum 12, as is known in the art. Other motors, such as an induction motor or a permanent split capacitor (PSC) motor, can also be used. The motor 54 can rotationally drive the drum 12 including that the motor 54 can rotate the drum 12 at various speeds in either rotational direction.

The control system can control the operation of the laundry treating appliance 10 to implement one or more cycles of operation. The control system can include a controller 58 located within the cabinet 14 and a user interface 59 that can be operably coupled with the controller 58. The user interface 59 can provide an input and output function for the controller. The user interface 59 can include one or more knobs, dials, switches, displays, touchscreens, and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection, and cycle parameters, such as cycle options. Other communications paths and methods can also be included in the laundry treating appliance 10 and can allow the controller 58 to communicate with the user in a variety of ways. For example, the controller 58 can be configured to send a text message to the user, send an electronic mail to the user, or provide audio information to the user either through the laundry treating appliance 10 or utilizing another device such as a mobile phone.

The controller 58 can include the machine controller and any additional controllers provided for controlling any of the components of the laundry treating appliance 10. For example, the controller 58 can include the machine controller and a motor controller. Many known types of controllers can be used for the controller 58. The specific type of controller is not germane to the present disclosure. It is contemplated that the controller can be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), can be used to control the various components.

Figure 2:
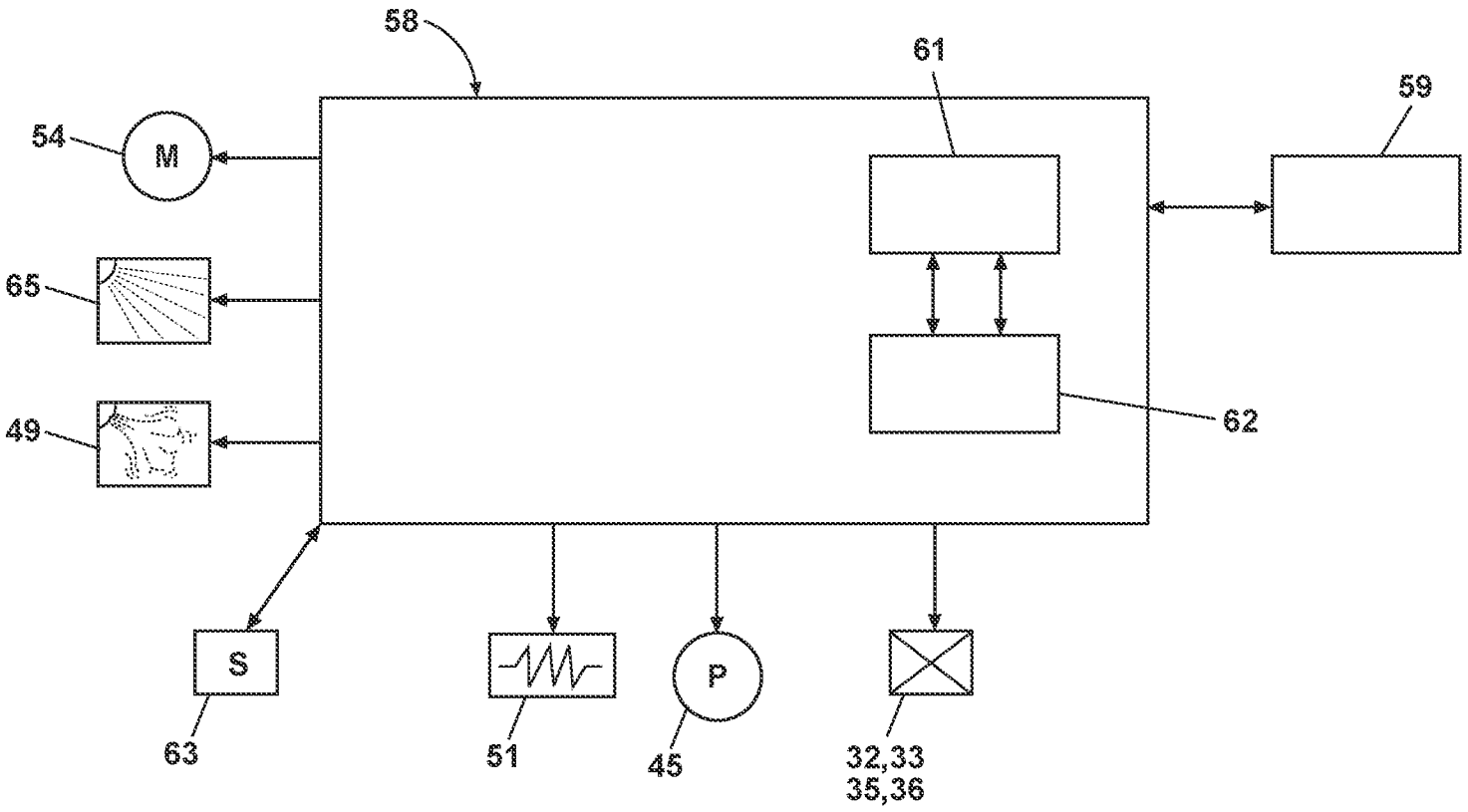
FIG. 2 is a schematic representation of a control system for controlling the operation of the laundry treating appliance of FIG. 1.

As illustrated in FIG. 2, the controller 58 can be provided with a memory 61 and a central processing unit (CPU) 62. The memory 61 can be used for storing the control software that can be executed by the CPU 62 in completing a cycle of operation using the laundry treating appliance 10 and any additional software. For example, the memory 61 can store a set of executable instructions including at least one user-selectable cycle of operation. Examples, without limitation, of cycles of operation include: wash, heavy duty wash, delicate wash, quick wash, pre-wash, refresh, rinse only, and timed wash. The memory 61 can also be used to store information, such as a database or table, and to store data received from one or more components of the laundry treating appliance 10 that can be communicably coupled with the controller 58. The database or table can be used to store the various operating parameters for the one or more cycles of operation, including factory default values for the operating parameters and any adjustments to them by the control system or by user input.

The controller 58 can be operably coupled with one or more components of the laundry treating appliance 10 for communicating with and controlling the operation of the component to complete a cycle of operation. For example, the controller 58 can be operably coupled with the motor 54, the pump 45, the treating chemistry dispenser 65, the steam generator 49 and the sump heater 51 to control the operation of these and other components to implement one or more of the cycles of operation The controller 58 can also be coupled with one or more sensors 63 provided in one or more of the systems of the laundry treating appliance 10 to receive input from the sensors 63, which are known in the art and not shown for simplicity. Non-limiting examples of sensors 63 that can be communicably coupled with the controller 58 include: a treating chamber temperature sensor, a moisture sensor, a weight sensor, a chemical sensor, a position sensor, an imbalance sensor, a load size sensor, and a motor torque sensor, which can be used to determine a variety of system and laundry characteristics, such as laundry load inertia or mass.

Figure 3:
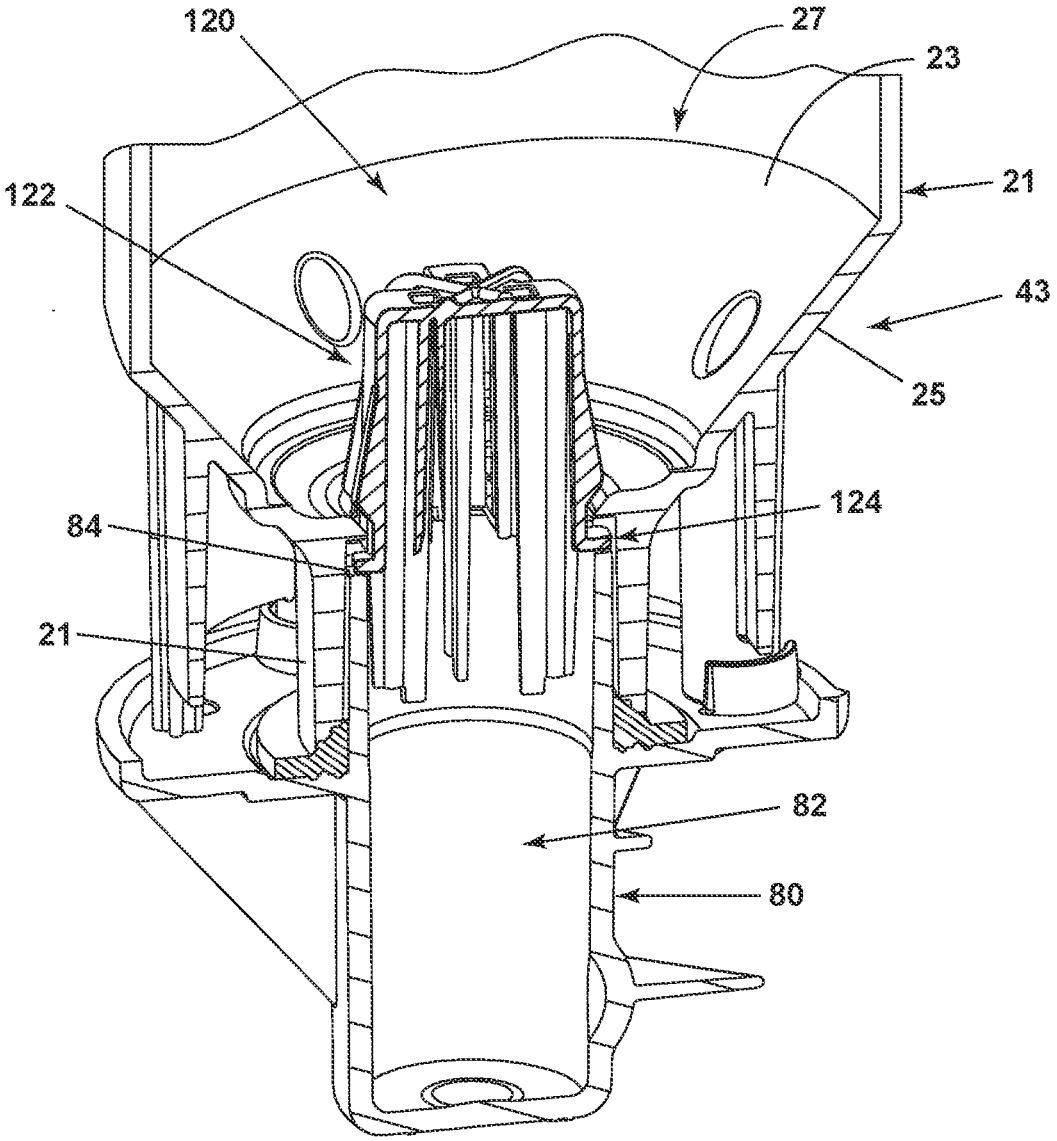
FIG. 3 illustrates a cross-sectional perspective view of an exemplary drain assembly in accordance with various aspects described herein.

Turning now to FIG. 3, a portion of the recirculation and drain system is illustrated in greater detail. The recirculation and drain system can include an outlet opening in the tub wall, illustrated as outlet 70 formed in the wall 21. While the outlet opening is illustrated as a drain outlet, it could be any outlet connected to any pump. The sump 43 can be separate from the tub and disposed adjacent the outlet 70 and/or can be integrally formed with the tub 20. Additionally, and alternatively, the sump 43 can be mounted as a separate piece to the tub 20. In one non-limiting example, the outlet 70 can be circumscribed by an edge 72 formed from wall 21. The edge 72 connects the inner surface 23 and outer surface 25 of the wall 21. The edge 72 extends radially inwardly from the sump 43 around the outlet 70.

A pump case 80 for housing the drain pump 45 can be included in the recirculation and drain system. The pump case 80 defines a pump conduit 82 to fluidly connect the outlet 70 to the drain conduit 46 (not shown). The outlet 70, for example, can receive a portion of a pump case 80 from the side opposite the liquid chamber 27. The pump case 80 can have a terminal edge or catch 84 that can be seated within the outlet 70 at the edge 72, beneath the sump 43. The liquid chamber 27 is thus fluidly coupled to the sump conduit 44 and the pump 45 (not shown).

The pump case 80 is a conduit that fluidly couples the sump to the inlet of the pump 45. While in most implementations, the pump case 80 is a rigid member, like a casing or housing, it can be flexible, like a hose. The pump case 80 can be thought of as part of a pump assembly that includes the pump and the pump case 80. When the pump 45 includes two pumps, both a drain pump and a recirculation pump, the pump case 80 can fluidly couple both to the sump. The pump case 80 can, in some implementations, be integrally formed with the pump.

The foreign objects barrier 120 can be situated within the outlet 70 to prevent foreign objects, especially more rigid objects like coins, keys, etc., from passing through the outlet 70. A filter 122 can be included in the foreign objects barrier 120 and prevent objects from flowing directly through the outlet 70. Thus, any foreign objects would need to pass through the filter 122 before reaching the pump 45. The filter 122 can be shaped to extend through the outlet 70 and into the sump or liquid chamber 27. The filter 122 can be a resilient sieve, made of lightweight polymeric material that can flex and bend.

Figure 4:
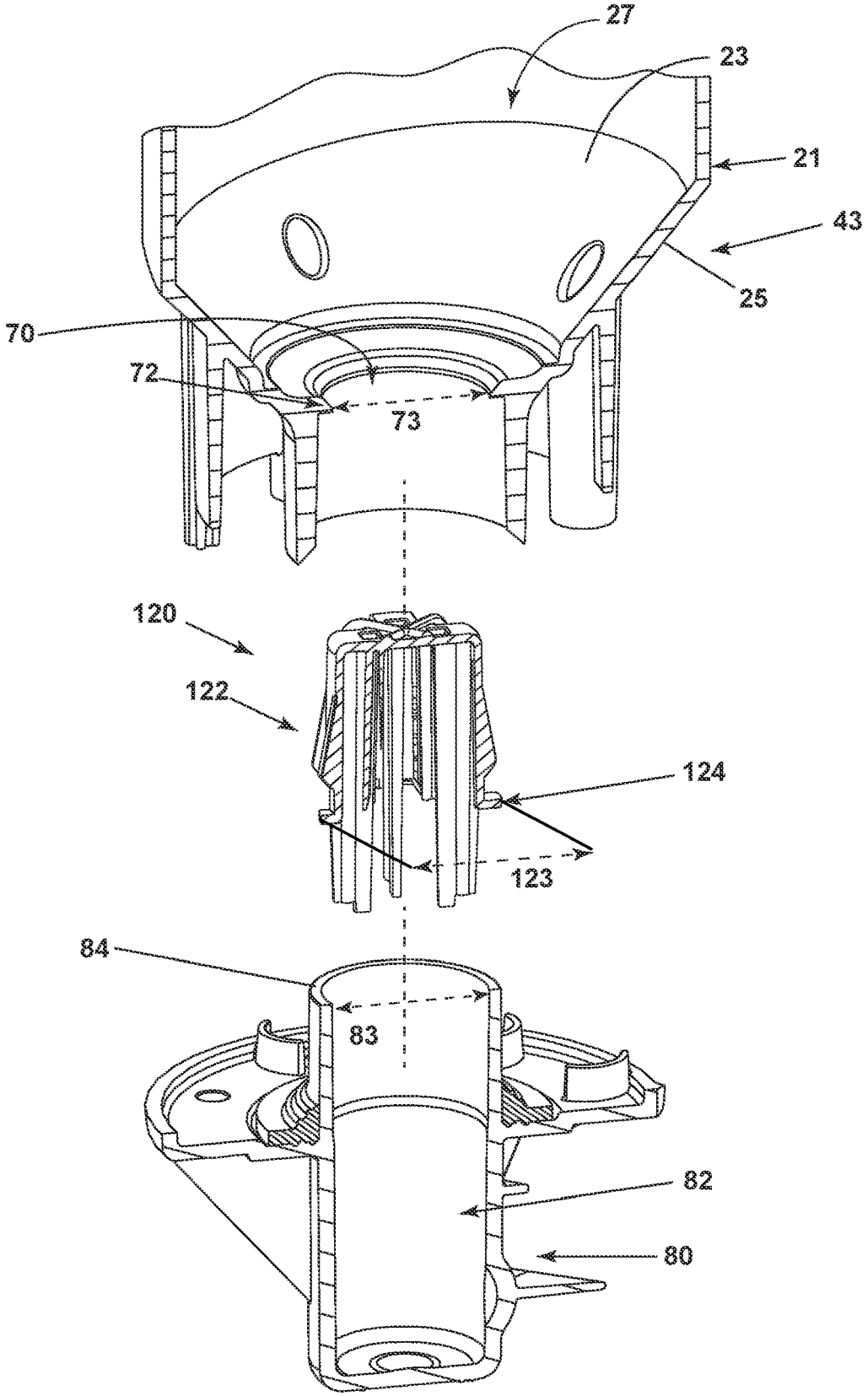
FIG. 4 illustrates an exploded view of the drain assembly of FIG. 3.

The outlet 70, foreign objects barrier 120, and pump case 80 are shown in exploded view in FIG. 4. The outlet 70 has an outlet diameter 73. The pump conduit 82 has a conduit diameter 83. The stop 124 has a collar diameter 123. The collar diameter 123 can be greater than the outlet diameter 73, such that the foreign objects barrier 120 is obstructed by the edge 72 and cannot move through the outlet 70 into the liquid chamber 27. The collar diameter 123 can be about the same as or smaller than the conduit diameter 83.

Figure 5:
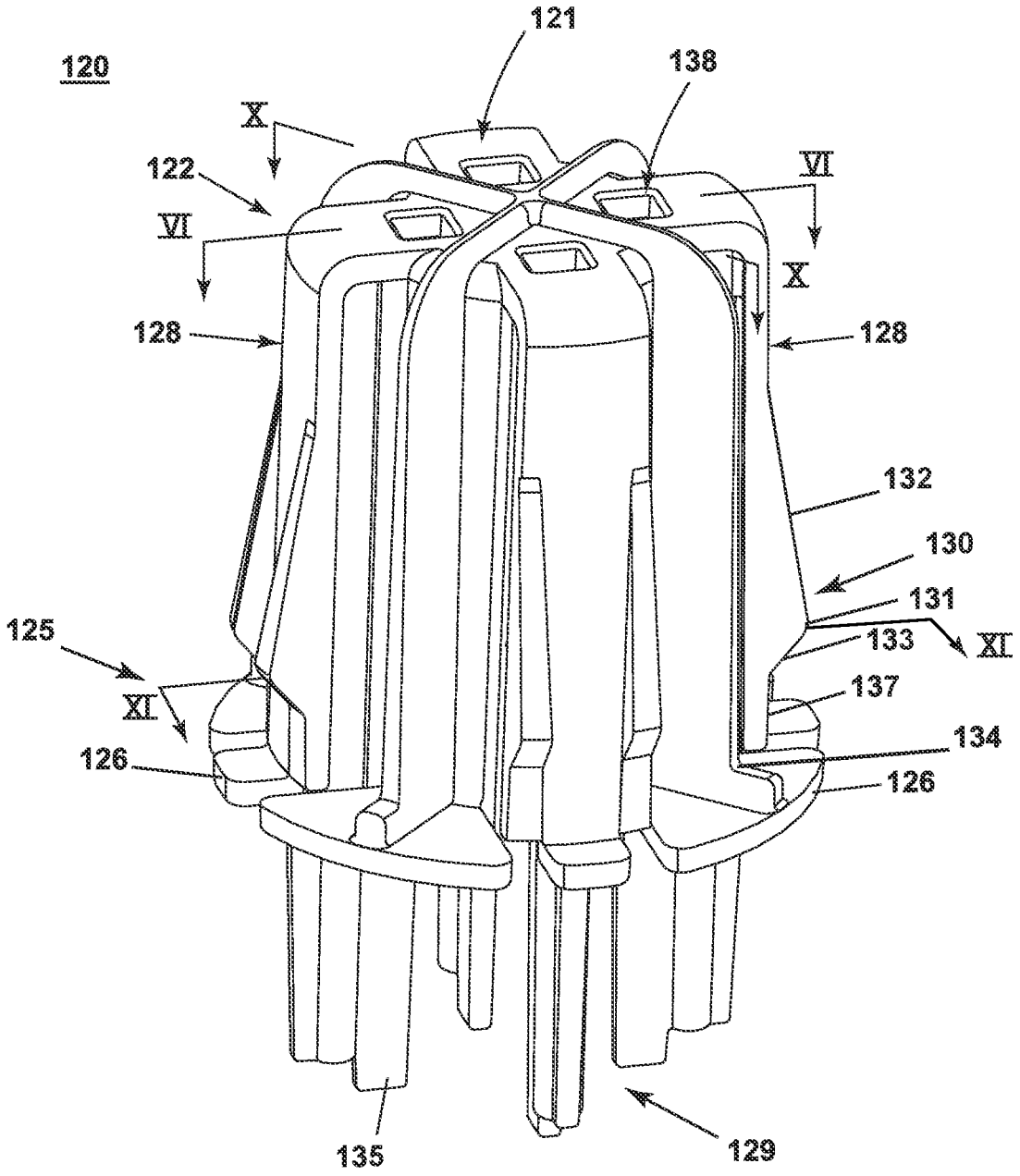
FIG. 5 illustrates a foreign objects barrier, in accordance with various aspects described herein.

Turning now to FIG. 5, the foreign objects barrier 120 is shown in greater detail. A top surface 121 can be included in the filter 122 to help prevent small objects from entering the filter 122 from above. The stop 124 can be formed as a collar 125 extending radially from the filter 122. The collar 125 can be non-continuous, formed by a set of circumferentially spaced tangs 126. The collar 125 can at least partially overlie the outer surface 25, for example at the edge 72 of the outlet 70.

The filter 122 can include multiple spaced fingers 128. In one non-limiting example, one end of at least some of the spaced fingers 128 can join the top surface 121. The spacing between the fingers 128 provides slits 129 to allow fluid to pass through while blocking small solid objects. At least some of the fingers 128 can support the tangs 126. In one non-limiting example, each finger 128 has a tang 126.

The filter 122 further includes multiple fins 130 that extend outwardly from and along at least a portion of the length of the fingers 128. At least some of the fingers 128 can have at least one fin 130. Each fin 130 can have a tip 131 at the widest point of the fin 130. Each fin 130 can further include an upper edge 132 extending along the finger 128 towards the top surface 121 away from the tip 131. The upper edge 132 can have a sloping linear profile tapering in the direction of the top surface 121. Additionally, and alternatively, the upper edge 132 can have a curved profile. Each fin 130 can further include a lower edge 133. The lower edge 133 can have a sloping linear profile tapering in the direction of the collar 125 away from the tip 131. The lower edge 133 ends at an indent 137 above and spaced from the tangs 126.

At least some of the fingers 128 can have a raised tab 134. The raised tab 134 can extend along at least from the finger 128 to the outermost portion of the tang 126. In one non-limiting example, the raised tab 134 can extend continuously along the entirety of the finger 128 and the tang 126 or any portion thereof. The fingers 128 can further include ribs 135 that extend along the fingers 128 opposite the fins 130. In an aspect, the top surface 121 can have openings 138 that support the flexibility of fingers 128. Each of the fingers 128 can be attached to one side of one of the openings 138.

Figure 6:
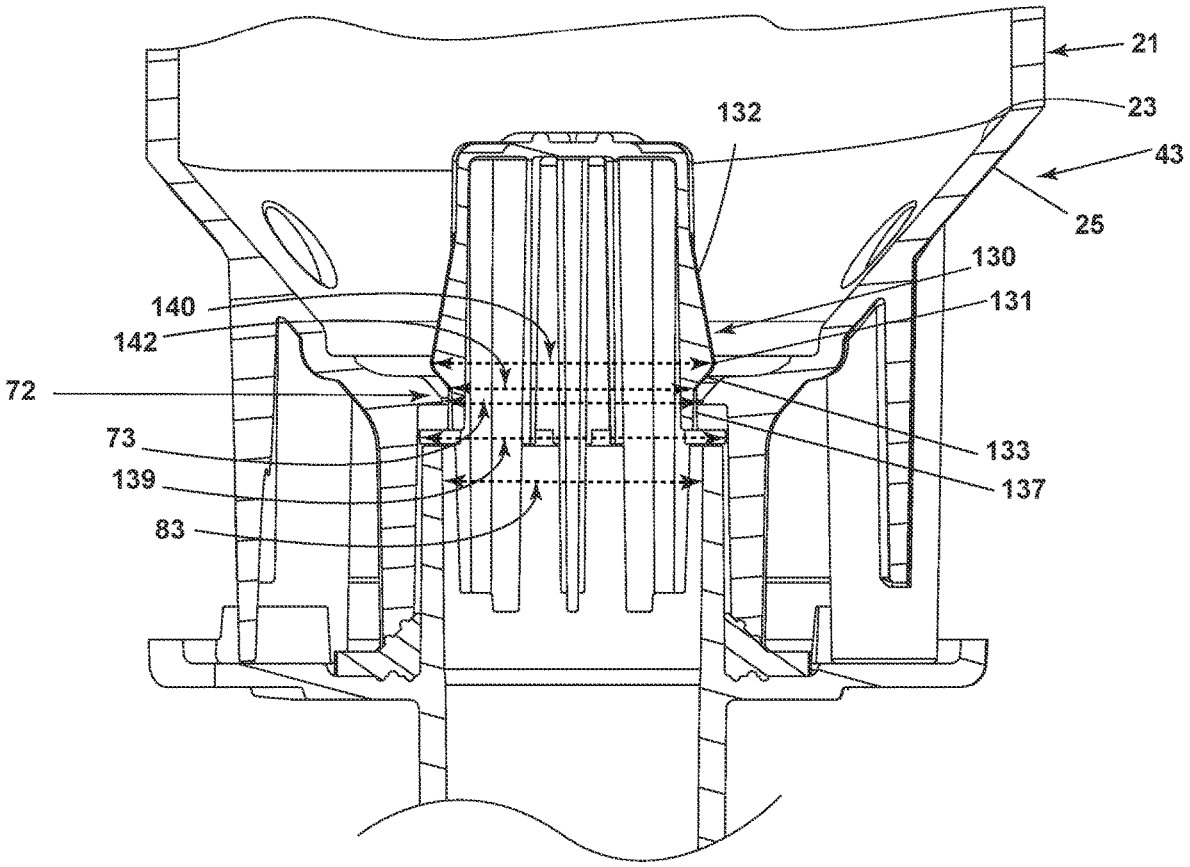
FIG. 6 illustrates a cross-sectional view of an exemplary drain assembly in accordance with various aspects described herein.

FIG. 6. shows another cross-sectional view of the foreign objects barrier 120 installed in the outlet 70 with the pump case 80, showing the placement of the filter 122 in the outlet 70. The tips 131 can overlie the inner surface 23 while the tangs 126 overlie the outer surface 25 at the edge 72. The filter 122 can define a first effective diameter, or a fin diameter 140 between opposite tips 131. The fin diameter 140 is greater than the outlet diameter 73. The fin diameter 140 can be greater than the pump conduit diameter 83. The filter 122 can further define a second effective diameter, or an inside diameter 142 between opposite indents 137. The inside diameter 142 is less than the fin diameter 140.

Figure 7:
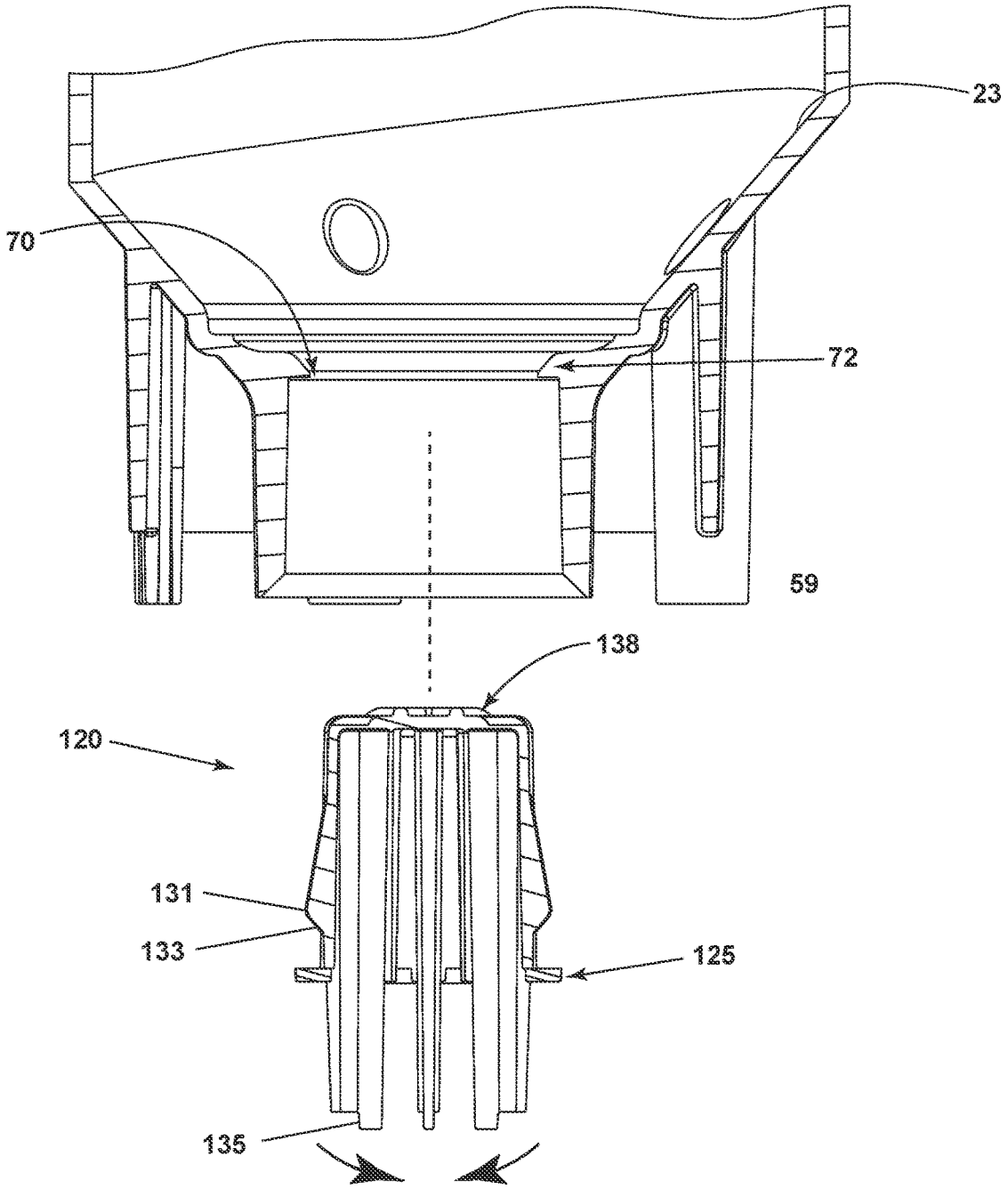
FIG. 7 illustrates a preinstallation position of the foreign objects barrier and the exemplary drain assembly of FIG. 3.

FIG. 7 shows a first step in the installation of the foreign objects barrier 120 in the outlet 70. The fingers 128 can be deflected inward (arrows) by squeezing the ribs 135 together to temporarily reduce the fin diameter 140 (not shown) of the filter 122. Openings 138 can provide flexibility for the inward or outward deflection of the ribs 135. In the squeezed conformation, the filter 122 can be inserted through the outlet 70 with an axial movement such that the upper edge 132 is pressed along edge 72. Once the tips 131 have passed through the outlet 70, the ribs 135 can be released. Due to the inherent resiliency of the filter 122 and the ramped surface of lower edge 133, the filter 122 can move into position such that the collar 125 is just below the outlet 70.

Figure 8:
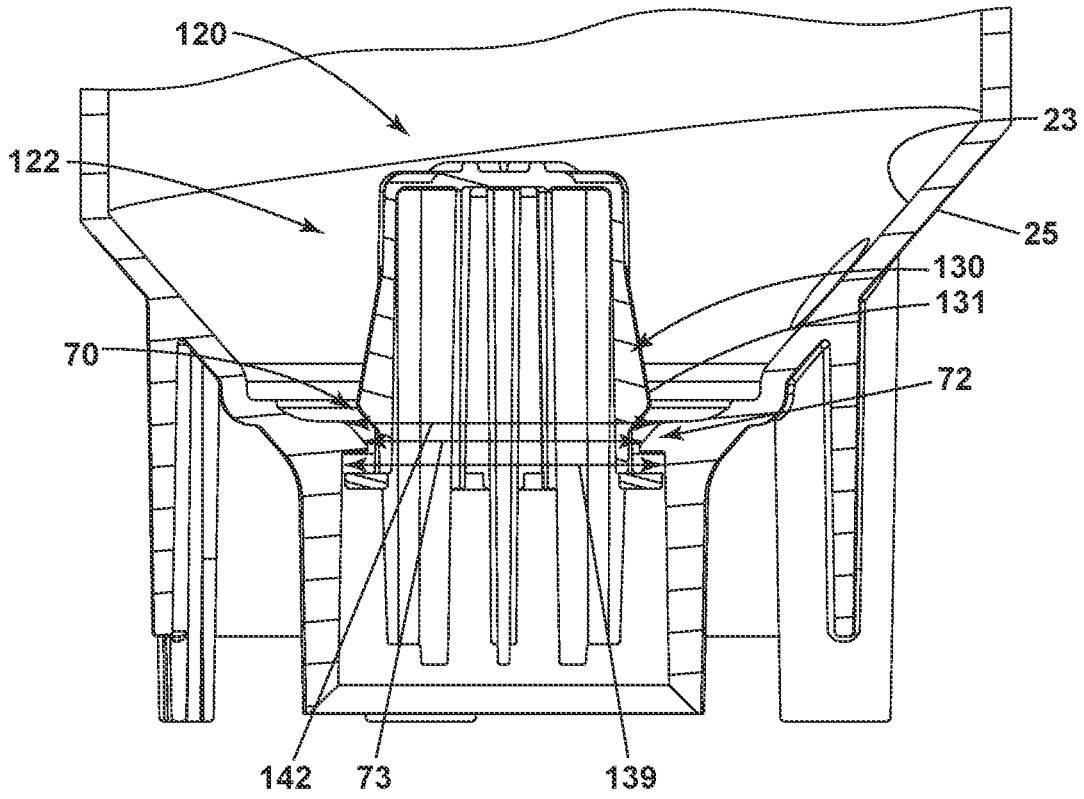
FIG. 8 illustrates another preinstallation position of the foreign objects barrier and the exemplary drain assembly of FIG. 3.

FIG. 8 shows an intermediate step in the installation of the foreign objects barrier 120. In this step, the filter 122 is positioned such that the fins 130 overlie the edge 72 of the outlet 70. The collar 125 underlies the edge 72 of the outlet 70. In this conformation, the tips 131 can overlie the inner surface 23 while the tangs 126 overlie the outer surface 25 at the edge 72. The fin diameter 140 is greater than the outlet diameter 73, so the foreign objects barrier 120 is held within the outlet 70 and cannot pass through because the fins 130 overlie the edge 72. The inside diameter 142 can be smaller than the outlet diameter 73. The collar diameter 139 can be greater than the outlet diameter 73, such that the foreign objects barrier 120 cannot move through the outlet into the liquid chamber.

Figure 9:
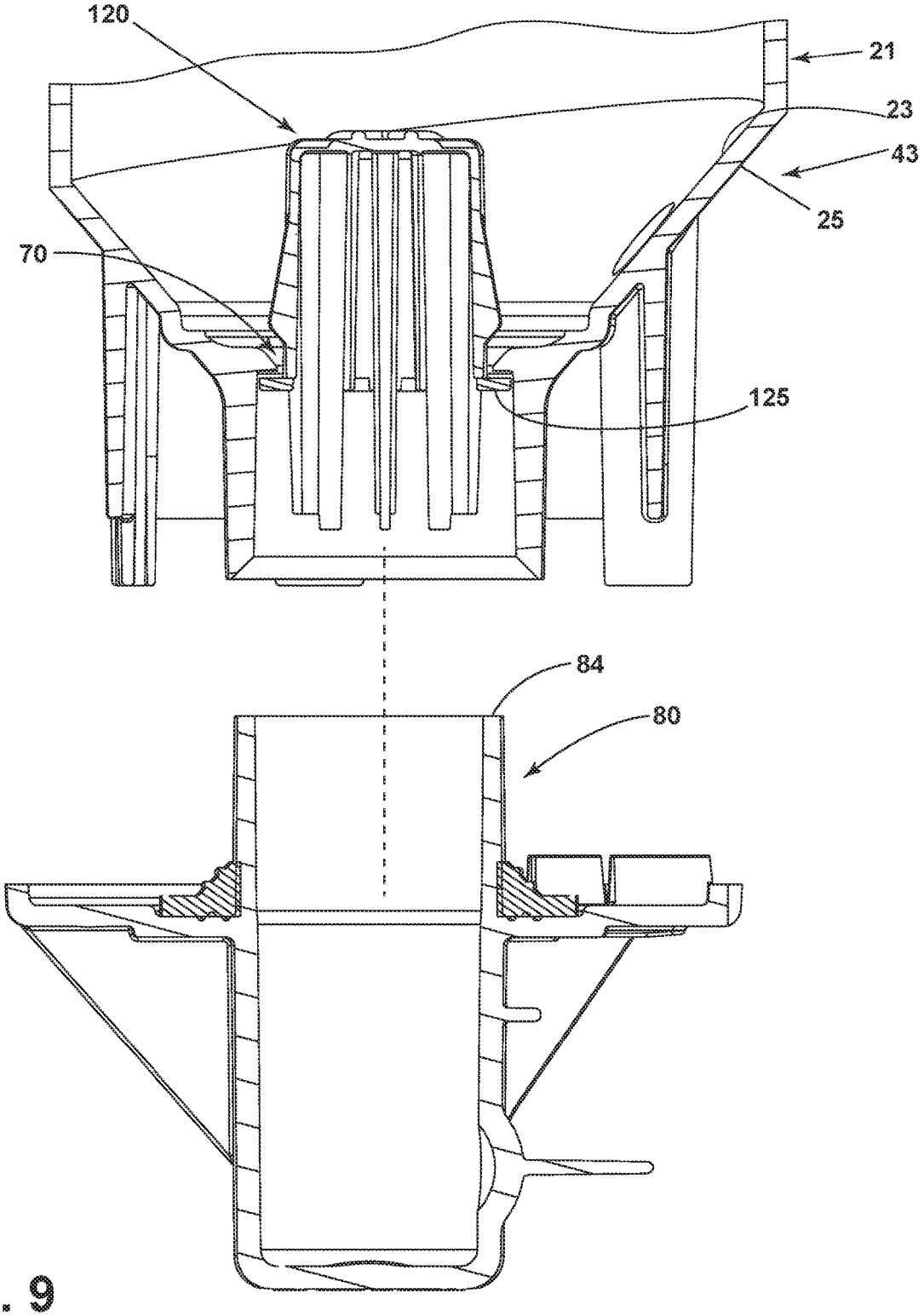
FIG. 9 illustrates another preinstallation position of the foreign objects barrier and the exemplary drain assembly of FIG. 3.

In the next step, as shown in FIG. 9, the pump case 80 is aligned axially with the outlet 70. For the next step of installation, the pump case 80 is moved axially towards the outlet 70 and stops at the point where the catch 84 presses against the collar 125.

Figure 10:
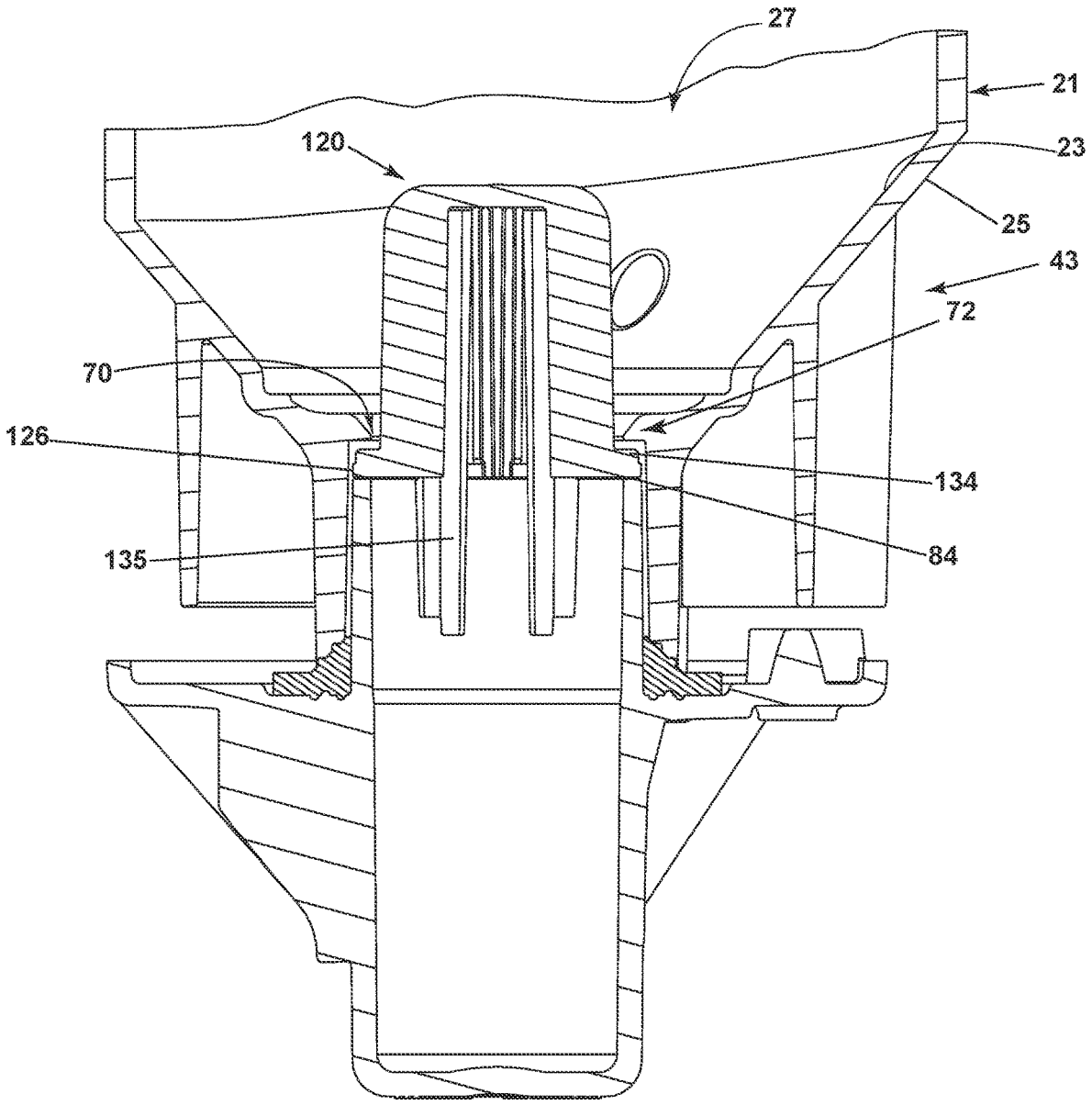
FIG. 10 illustrates another cross-sectional view of an exemplary drain assembly of FIG. 3, in accordance with various aspects described herein.

FIG. 10 illustrates the positioning of the foreign objects barrier 120 in the outlet 70 and the pump case 80. The raised tab 134 along with the tang 126 can be confined between the catch 84 and the outer surface 25 at edge 72. In this way the raised tab 134 can fill the gap between the edge 72 and the catch 84 to help prevent motion of the foreign objects barrier 120. The foreign objects barrier 120 can thus be trapped between the outlet 70 and the pump case 80.

The filter can be configured to be relatively axially fixed to the outlet 70. For example, at least a portion of the filter 122 can at least partially overlie the inner surface 23, for example at the edge 72 of the outlet 70, which prevents the filter 122 from being moved axially through the outlet 70 toward the pump case 80. The stop 124 overlies a portion of the outer surface 25, which prevents the axial movement of the filter 122 toward the liquid chamber 27. Additionally, the catch 84 is located on the opposite side of the stop 124 than the edge 72. When so assembled, the stop 124 can be trapped between the outer surface 25 and the catch 84, which further prevents axial movement of the filter 122 toward the pump case 80.

Figure 11:
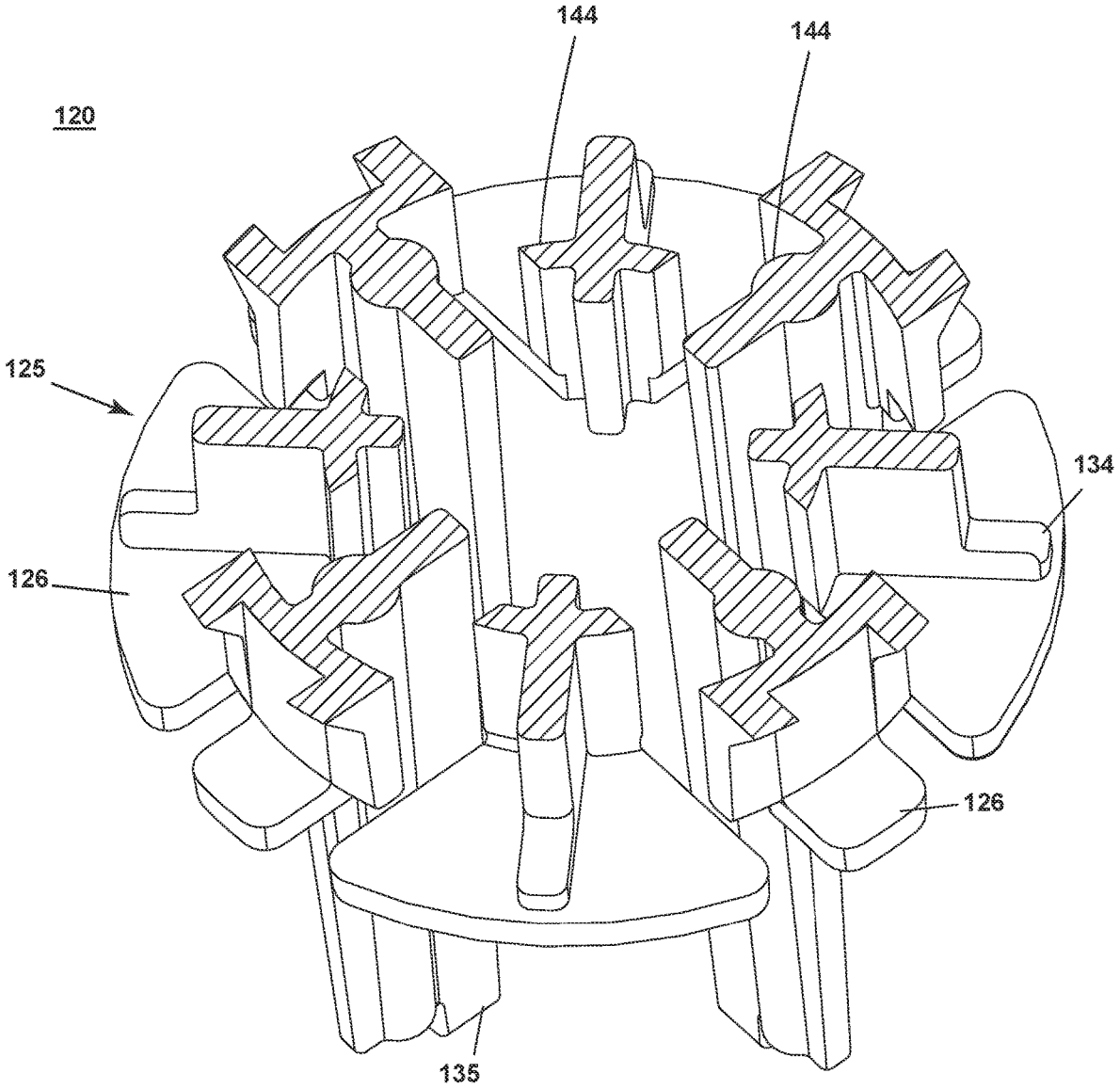
FIG. 11 illustrates a cross-sectional perspective view of the foreign objects barrier of FIG. 5, in accordance with various aspects described herein.

FIG. 11 shows a cross sectional perspective view of the foreign objects barrier 120. The fingers 128 can have labyrinthian features 144 in the interior of filter 122. Together these labyrinthian features 144 provide a tortuous pathway to catch small solid items yet allow fluid to flow through from the liquid chamber through the outlet 70. The labyrinthian features can be, for example, no more than 3 mm apart. In one non-limiting example, the features 144 can be branches on the interior of raised tab 134 or bulbous regions on the ribs 135.

Small hard objects such as coins, screws, wires, clips, or rocks can inadvertently be introduced into a washer along with normal clothes and bedding. These hard objects can damage the pump if they pass through the outlet into the pump conduit. The foreign objects barrier disclosed herein can prevent these objects from entering the recirculation and drain system.

To the extent not already described, the different features and structures of the various embodiments can be used in combination with each other as desired, or can be used separately. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A laundry treating appliance comprising:

a tub having a wall having an outer surface and an inner surface, with the inner surface at least partially defining a liquid chamber;

an outlet formed in the wall;

a foreign object barrier having a filter extending through the outlet and into the liquid chamber, and a stop extending from a portion thereof, the stop confronting the outer surface; and a pump case fluidly coupled to the outlet and having a catch, the catch located on an opposite side of the stop than the outer surface to trap the stop between the outer surface and the catch.

2. The laundry treating appliance of claim 1, wherein the wall includes a sump and the outlet is in the sump.

3. The laundry treating appliance of claim 1, wherein the filter comprises multiple slits for liquid to pass through.

4. The laundry treating appliance of claim 3, wherein the filter comprises multiple, spaced fingers forming the multiple slits.

5. The laundry treating appliance of claim 4, wherein the spaced fingers are deflectable.

6. The laundry treating appliance of claim 5, wherein the stop comprises multiple, spaced tangs, with at least some of the spaced tangs extending from some of the spaced fingers.

7. The laundry treating appliance of claim 6, wherein the filter further comprises multiple fins, with at least some of the spaced fingers having at least one of the multiple fins.

8. The laundry treating appliance of claim 7, wherein the multiple fins define a first effective diameter that is larger than a diameter of the outlet.

9. The laundry treating appliance of claim 8 wherein the multiple fins define a second effective diameter near the inner surface that is less than the first effective diameter.

10. The laundry treating appliance of claim 9 wherein each of the multiple fins has a tip overlaying the inner surface while the spaced tangs overlie the outer surface in a preinstallation position.

11. The laundry treating appliance of claim 1, wherein the pump case includes a pump conduit having the catch.

12. The laundry treating appliance of claim 1, wherein the stop is configured to prevent movement of the foreign object barrier.

13. A laundry treating appliance comprising:

a tub having a wall having an outer surface and an inner surface, with the inner surface at least partially defining a liquid chamber;

an outlet formed in the wall;

a foreign object barrier having a filter extending through the outlet and into the liquid chamber, and a stop in the form of a collar, wherein the collar is non-continuous, the stop confronting the outer surface; and a pump case fluidly coupled to the outlet and having a catch located on an opposite side of the stop than the outer surface to trap the stop between the outer surface and the catch.

14. The laundry treating appliance of claim 13, wherein the collar comprises multiple circumferentially spaced tangs.

15. A laundry treating appliance comprising:

a tub having a wall having an outer surface and an inner surface, with the inner surface at least partially defining a liquid chamber;

an outlet formed in the wall;

a filter having a resilient sieve, at least partially overlying the inner surface, and a collar, at least partially overlying the outer surface, wherein the collar is non-continuous; and a pump assembly having a portion confronting the collar, thereby limiting the axial movement of the filter toward the portion of the pump assembly.

16. The laundry treating appliance of claim 15 wherein the filter comprises a first effective diameter portion, less than the outlet and passing through the outlet, and a second effective diameter portion, greater than the outlet and located above the inner surface.

17. The laundry treating appliance of claim 16 wherein the filter further comprises multiple, spaced, deflectable fingers forming the second effective diameter portion.

18. The laundry treating appliance of claim 17 wherein at least some of the deflectable fingers comprise a fin to define a set of fins.

19. The laundry treating appliance of claim 18 wherein at least some of the set of fins terminate prior to the first effective diameter portion.

20. The laundry treating appliance of claim 18 wherein at least some of the deflectable fingers comprise a tang to define a set of spaced tangs, with the set of spaced tangs defining the collar.

* * * * *